United States Patent [19]

Coon

[11] 4,261,121

[45] Apr. 14, 1981

[54] ADVERTISING AND DISPLAY CLIP

[75] Inventor: Miles Coon, Great Neck, N.Y.

[73] Assignee: Red Wing Products, Inc., Plainview, N.Y.

[21] Appl. No.: 915,726

[22] Filed: Jun. 15, 1978

[51] Int. Cl.[3] ..... G09F 3/18

[52] U.S. Cl. ..... 40/332; 40/23 A; 40/11 R

[58] Field of Search ..... 40/322, 2 A, 300, 11 R, 40/23, 23 A, 359, 360; 24/67, 67.11, 67.9, 67.7, 67.3

[56] References Cited

U.S. PATENT DOCUMENTS

| | | | |
|---|---|---|---|
| 2,594,228 | 4/1952 | Smith | 40/322 |
| 3,089,269 | 5/1963 | McKiernan | 40/622 |
| 3,335,467 | 8/1967 | Freed | 40/21 R |
| 3,650,058 | 3/1972 | Wittcke et al. | 40/300 |
| 3,763,820 | 10/1973 | Sage | 40/2 A X |

FOREIGN PATENT DOCUMENTS

| | | | |
|---|---|---|---|
| 367486 | 1/1923 | Fed. Rep. of Germany | 40/11 R |
| 1360247 | 3/1964 | France | 40/11 R |

*Primary Examiner*—Gene Mancene
*Assistant Examiner*—Wenceslao J. Contreras
*Attorney, Agent, or Firm*—Kenyon & Kenyon

[57] ABSTRACT

A plastic clamping clip is disclosed which not only securely fastens together and hangs documents, garments, film, and fabrics, but also prominently and permanently displays advertising, promotional and labeling information such as firm name, brand name, address, phone number, size, price, etc. The clip has an easily but permanently attachable shaped display member which can be secured in place to display the particular labeling or promotional information desired. The clips can also be manufactured as part of a garment hanger.

6 Claims, 7 Drawing Figures

ADVERTISING AND DISPLAY CLIP

This invention relates to clips and particularly to clamping clips for holding documentary, display or fabric materials. Still more particularly, this invention relates to clips which can be incorporated in garment hangers.

Heretofore, various types of clips and hanger constructions have been known for fastening and hanging documentary or display materials as well as garments, for example, as described in U.S. Pat. Nos. 3,456,262 and 4,009,807.

It has also been known to use labelling and promotional information, such as manufacturer or store brand names, size, price, fabric content and/or care and cleaning instructions, in merchandising garments. Generally, this has been accomplished with the use of hang tags or labels attached to a hung garment. However, this information has frequently been hidden from view because the hang tags and labels tend to become hidden in the folds of the garments on a garment rack. As a result, in those cases, a customer has been required to handle the garment and grope for the tag or label to obtain the sought-after information.

It has also been known to use promotional information such as firm or brand name, address and phone number, slogans, etc. on useful items that will be retained by the recipient in his home, office, automobile and travels. However, a simple means for holding and/or displaying this information has generally not been available.

Accordingly, it is an object of the invention to provide advertising and display information on a clip in a simple manner and readily visible location.

It is another object of the invention to provide a display clip for use with garment hangers which can be used to display brand name, price, size or other information concerning a supported garment.

It is another object of the invention to provide an advertising and display clip which can be economically manufactured.

It is another object of the invention to provide a clip which is capable of holding materials together while displaying advertising media.

It is another object of the invention to provide a garment hanger which can be used to display brand name, price, size, or other information concerning the garment in a prominent manner.

Briefly, the invention provides a display member which can be mounted on a handle portion of a jaw of a clamping clip in non-releasable manner by a suitable means. To this end, the handle portion of the jaw is provided with an aperture while the mounting means is integrally formed with the display member to extend through the aperture and mount the display member on the handle portion in a locked non-releasable manner.

The clip may be formed with two jaws which are biased together in a normally closed position. In this case, at least one, and preferably both, of the jaws are provided with an aperture in a handle end for attachment of a separate display member carrying advertising, promotional or labelling information. The means on the display member for mounting on the clip is in the form of a hollow stem which extends from the display member through the aperture in the handle portion and which has at least one shoulder spaced from the display member and disposed on an opposite side of the handle portion from the display member. The shoulder is sized and shaped relative to the aperture of the handle portion to be snapped through the aperture.

Where both jaws have apertures in a handle portion, either one or two shaped display members can be affixed to the clip. If only one display member is so affixed, the other aperture can be used, for example, to receive a key chain or to hang the clip and any materials held thereby on a hook, peg board, pin or the like. This other aperture may also be used for the purposes of riveting a magnet or suction cup to the clip.

The clip can also be incorporated into a garment hanger as a separate member or an integrated member. One or more shaped display members carrying the particular brand name, size, price or other advertising, promotional or labelling information desired by the user can then be snapped into place in suitable apertured portions of the clip.

These and other objects and advantages of the invention will become more apparent from the following detailed description taken in conjunction with the following drawings in which.

Figure 1:
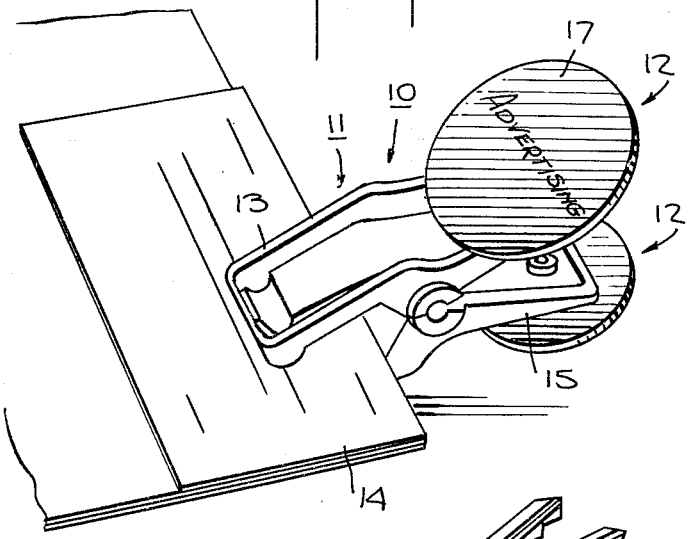
FIG. 1 is a perspective view of a clamping clip in accordance with the invention.

Referring to FIG. 1, the clamping clip 10 comprises a pair of jaws 11 which are disposed in opposed relation for pivoting relative to each other and a pair of shaped display members 12 which are mounted on the jaws 11. Each jaw 11 has a gripping end 13 for engaging a garment 14 or other item and a handle portion 15 by which the clip 10 can be manually grasped for opening and closing purposes. Each handle portion 15 is also provided with an aperture 16 (FIG. 3) at a suitable location.

Figure 6:
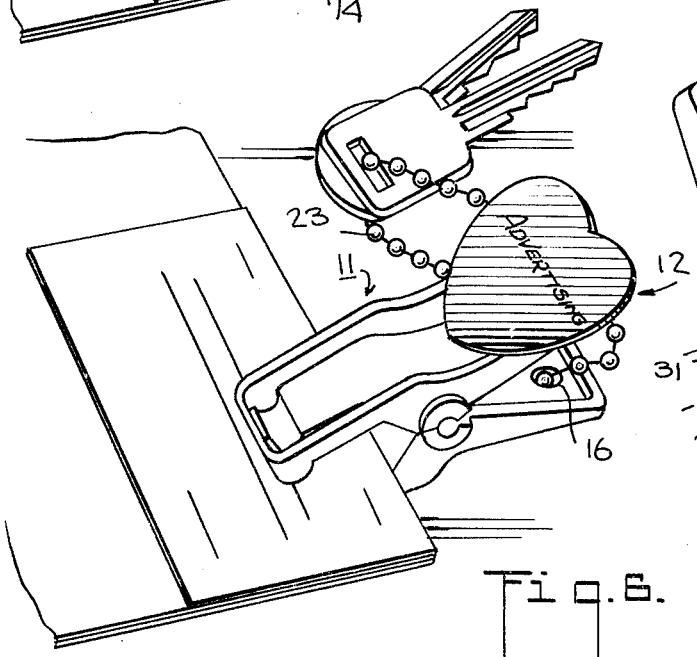
FIG. 6 is a perspective view of an alternative embodiment of a clip used with a key chain in accordance with the invention.

Each display member 12 is formed with a display surface 17, for example of flat disc shape which also serve as surfaces for squeezing the ends of the handle portions 15 of the clip 10. The shaped display members 12 are generally smooth to avoid sharp edges in the region where the clip is held and operated. However, the display members 12 may be of other shapes such as squares, rectangles, ovals and other geometric shapes (such as a heart-shape as shown in FIG. 6), or cut-out shapes in the configuration of particular objects, letters or numerals. The display members 12 may also have three-dimensional shapes (not shown) to enhance a particular advertising or promotional message.

Figure 2:
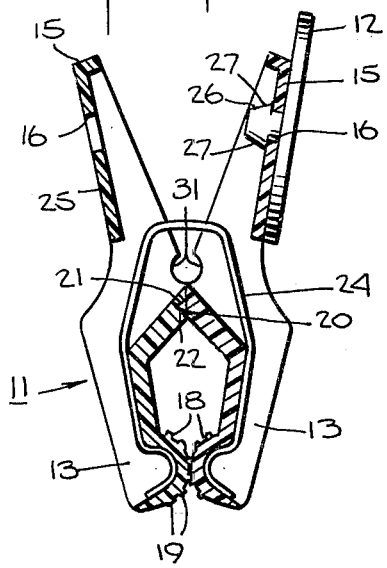
FIG. 2 is a cross-sectional view of the clip shown in FIG. 1, but with only one display member in place.
Figure 3:
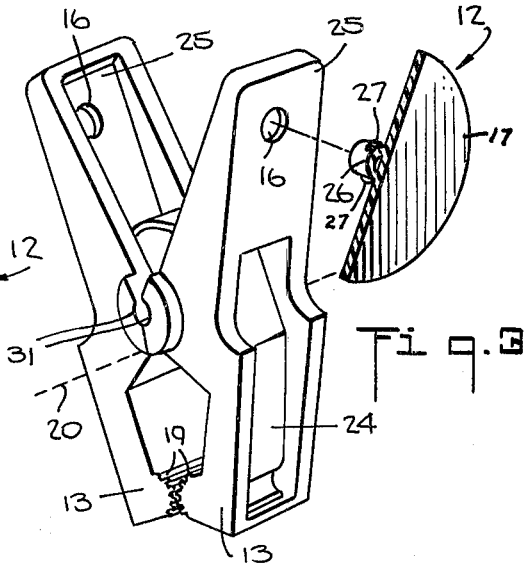
FIG. 3 is a partially exploded view of the clip and display member of FIG. 2.

Referring to FIGS. 2 and 3, the mutually opposed jaws 11 are generally substantially identical in construction for economy of manufacture, but this need not be the case. The gripping ends 13 of the jaws 11 have gripping surfaces 18 which protrude toward each other, preferably with gripping ridges 19.

The jaws 11 are pivotably mounted opposite each other along a transverse pivot axis 20 (FIG. 3) intermediate the gripping end 13 and the handle portion 15, such that movement of the handle portions 15 towards each other opens the gripping ends 13 away from each other and vice versa. Each jaw has a small protruding teat 21 and a spaced-apart recess 22 disposed along the pivot axis 20 which are adapted to engage a corresponding teat 21 and recess 22 in the other jaw as is known (see FIG. 2).

The clip 10 is held in a normally closed position with the gripping surfaces 18 of the jaws 11 abutting against each other and the handle portions 15 spaced apart by a suitable biasing means, such as a U-shaped spring 24. As shown in FIG. 2, the legs of the spring 24 straddle the pivot axis 20, pass through openings in the jaws 11, and fit snugly in recessed portions on the outside of the gripping end 13 of each jaw 11.

As shown in FIGS. 2 and 3, the handle portion 15 of each jaw 11 has a flat surface 25 in which the aperture 16 is formed. Each aperture 16 is circular in cross-section, however, any other suitable shape can be used.

Figure 4:
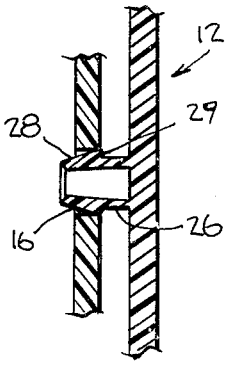
FIG. 4 illustrates a cross-sectional view of a display member and handle portion of a jaw prior to securement of the display member in place.
Figure 5:
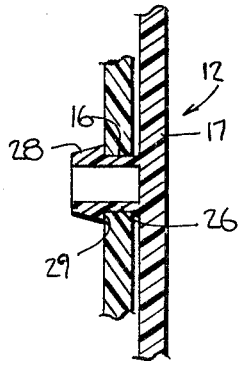
FIG. 5 illustrates a view similar to FIG. 4 of the display member in place.

Referring to FIGS. 2 and 3, a means is provided to attach each display member 12 to a respective jaw 11 in non-releasable manner. This means includes a cylindrical hollow stem 26 which is integrally formed on the back of the display member 12 and a pair of diametrically opposed shoulders 27 which extend radially from the stem 26. The stem 26 is dimensioned to match the cross-section of the aperture 16 so as to fit in the aperture 16 loosely enough to permit rotation of the display member 12 when deliberately rotated. However, there is sufficient frictional contact to prevent free rotation of the display member 12 when no force is applied. Each shoulder 27 is sized to sufficiently increase the size of the stem 26 in at least one cross-sectional dimension to prevent return passage of the stem 26 through the aperture 16. As shown in FIGS. 2, 4 and 5, each shoulder 27 extends radially of the stem 26 and is spaced from the display member 12 so as to be disposed on an opposite side of the handle portion 15. In addition, each shoulder 27 has a sloped portion 28 extending radially inwardly of the stem 26 (FIG. 4) in a direction extending away from the display surface 17 and a flat portion 29 extending radially of the stem 26 between the sloped portion 28 and the display surface 17 so as to engage the handle portion 15. Each sloped portion 28 and related aperture 16 are sized to permit passage of the stem 26 and shoulders 27 through the aperture 16 in snap-fit manner. Each sloped portion 28 merges into the circumferential surface of the stem 26 to form a smooth contoured shape which can be easily molded where the display member 12 is made of plastic. Once the display member 12 has been snapped into place, the locking shoulders 27 prevent the display member 12 from being removed (FIG. 5).

The jaws 11 of the clips 10 as well as the display members 12 can be made of a plastic material or of any other suitable material or materials which permit the display members to be received in a non-releasable manner. For example, the jaws may be made of plastic while the display members 12 are made of metal in whole or in part.

Depending upon a customer's wishes, the advertising, promotional or labelling information on the two shaped display members 12 of the embodiment shown in FIG. 1 can be the same or different. As an alternative, a single shaped display member 12 can be snapped into place on one of the jaws 11, and the aperture 16 of the other jaw used to hang the clip on a peg board or for a key chain 23, as shown in FIG. 6. Also, the aperture 16 of the other jaw may receive a rivet to hold a magnet or suction cup (not shown) on the clip.

Figure 7:
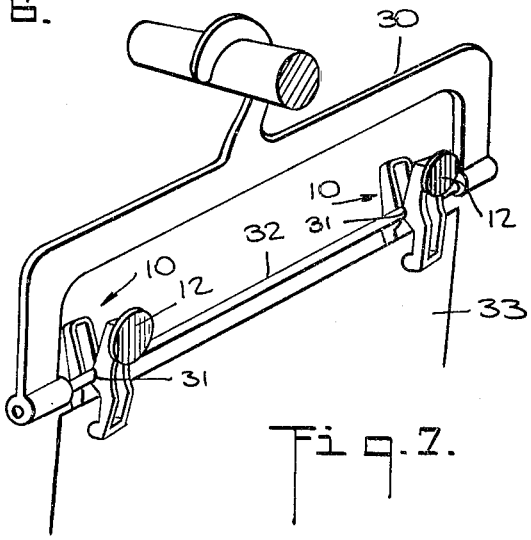
FIG. 7 is a perspective view of a pair of clips on a hanger in accordance with the invention.

Referring to FIG. 7, the clips 10 may also be incorporated into a hanger 30. To this end, each clip 10 can be formed with recesses 31 in each jaw 11 to fit about the bar 32 of the hanger 30. In this embodiment, the display members 12 can be used to convey labelling information about a garment 33, such as brand name, size, price and the like.

The hanger 30 may be of a conventional structure as shown in FIG. 7 or the clips may be integrally incorporated into the hanger as described in U.S. Pat. No. 4,009,807.

The invention thus provides a clip which can have one or more easily but permanently attachable shaped display members secured thereto on respective handle portions of the clip. This results in a substantial savings in manufacturing costs by permitting the heavier and more expensive parts of the clip to be standardized. The shaped display members can be separately molded, cut, or imprinted with a customer's particular advertising or promotional indicia or message and then snapped permanently in place, either as a final manufacturing step before delivery or, if the customer prefers, by the customer as each clip is put into use. Once in place, the display members can be rotated to orient the advertising or promotional message in accordance with the orientation of the clip when in use. The display members cannot be removed, thereby keeping the advertising or promotional message before the user as long as the clip is used.

When the clip is used with garment hangers to display garments for sale, the display members can be positioned in a prominent position for displaying information close to eye level and in a highly visible eye-catching manner. For example, the clips can be placed on the hanger near a customer aisle, e.g., in a retail outlet, manufacturer's showroom, and the like, or on the outside of a circular display ring of garments. The same display and promotional advantages stemming from the high visibility of the display members can be achieved with garment hangers which incorporate the clips as an integral part thereof.

The clip is also useful to hold papers on one's desk and on an auto visor; to clip a business card to sales literature; to hold badges at trade shows, to clip keys to a purse, belt, beachwear, etc.; and generally to hold things together while advertising a donor's name.

What is claimed is:

1. A clamping clip comprising a pair of jaws, at least one of said jaws including a handle portion having an aperture therein;

a display member having a flat display surface mounted on said handle portion; and a means integral with and extending from said display member and through said aperture of said handle portion rotatably mounting said display member on said handle portion in permenent non-releasable manner, said means including a hollow cylindrical stem extending from said member through said aperture and having a pair of diametrically disposed radially extending shoulders thereon, said shoulders being spaced from said member and disposed on an opposite side of said handle portion from said member.

2. A clip as set forth in claim 1 wherein said display surface is disc-shaped.

3. A clip as set forth in claim 1 wherein said display surface is shaped in the configuration of a particular indicia.

4. A clip as set forth in claim 1 having a second aperture disposed in said handle portion of the other of said jaws and a second shaped display member, said second shaped member being irremovably secured in said second aperture of said handle portion of said other jaw.

5. A clip as set forth in claim 1 having a second aperture disposed in the other of said jaws and a key chain passing through said second aperture.

6. A garment display hanger comprising a shaped hanger portion;

a plurality of clips mounted on the hanger portion to hang garments therefrom, each clip having a pair of opposed jaws disposed in movably mounted relation to each other, each jaw having a gripping end and a handle portion, at least one of said clips having an aperture in said handle portion of at least one of said jaws thereof, and biasing means for holding said gripping ends of said jaws in a normally abutting position; and a shaped display member having a flat display surface and a hollow cylindrical stem protruding from said display surface and extending through said aperture of said one clip, said stem having a radially extending shoulder engaging against said handle portion to rotatably secure said shaped display member to said handle portion, said shoulder being spaced from said display surface and disposed on an opposite side of said handle portion from said display surface.

* * * * *